US006364227B1

(12) United States Patent
Dorscht

(10) Patent No.: US 6,364,227 B1
(45) Date of Patent: Apr. 2, 2002

(54) INTERFACE ELEMENTS FOR SHREDDER MILLS

(76) Inventor: John Dorscht, 69 Georgain Crescent, Kitchener, Ontario (CA), N2B 3N8

( * ) Notice: Subject to any disclaimer, the term of this patent is extended or adjusted under 35 U.S.C. 154(b) by 0 days.

(21) Appl. No.: 09/598,683

(22) Filed: Jun. 21, 2000

(51) Int. Cl.[7] ..... B02C 13/28
(52) U.S. Cl. ..... 241/197; 241/294
(58) Field of Search ..... 241/195, 191, 241/197, 189.1, 294

(56) References Cited

U.S. PATENT DOCUMENTS

| | | | | |
|---|---|---|---|---|
| 1,648,747 A | | 11/1927 | Stoner | |
| 1,698,758 A | | 1/1929 | Knittel | |
| 1,773,408 A | | 8/1930 | Rolfsen | |
| 1,946,701 A | | 2/1934 | Knittel | |
| 2,143,068 A | | 1/1939 | Hartshorn | |
| 2,205,850 A | | 6/1940 | Griesedieck | |
| 3,580,518 A | | 5/1971 | Strom | |
| 3,591,096 A | | 7/1971 | DeFeo | |
| 3,838,826 A | * | 10/1974 | Wallace et al. | 241/294 |
| 4,077,573 A | | 3/1978 | Kersey et al. | |
| 4,149,677 A | | 4/1979 | Graveman et al. | |
| 4,826,090 A | * | 5/1989 | Orphall | 241/195 |
| 4,997,136 A | | 3/1991 | Becker | |
| 5,114,085 A | | 5/1992 | Inui | |
| 5,320,292 A | | 6/1994 | Smith | |
| 5,484,111 A | | 1/1996 | Dorscht et al. | |

* cited by examiner

*Primary Examiner*—Mark Rosenbaum

(74) *Attorney, Agent, or Firm*—R. Craig Armstrong

(57) ABSTRACT

An interlocking interchangeable interface element and rotor assembly comprising at least two rotor bodies, a plurality of interface element mounting cut-outs arranged substantially radially in the rotor bodies, a plurality of interface elements arranged to be mountable in the cut-outs and a plurality of peripheral mounting holes arranged to receive rotor body bundling means to hold the rotor bodies fixedly against each-other and to prevent the hammers to exit the interface element mounting cut-outs. Each of the interface elements has a substantially oblong and planar shape; a bottom end shaped to interlock with the cut-outs; a leading edge facing the direction of rotation of the rotors; a trailing edge facing the side opposite to the direction of rotation; and interface element tip mounting means, arranged in an upper mounting portion of each interface element. The interface elements further have a bottom portion with a generally rounded surface arranged to cooperate with a generally rounded bottom portion of the cutouts, a heel portion facing the direction of rotation and shaped to cooperate with a recess portion of the cutouts, so that during insertion of an individual interface element in one cut-out, by inserting the bottom portion first, the generally rounded surface is slidable into a relief recess portion of the cut-outs, permitting the heel portion to clear the protruding portion and the interface element to be seated with the bottom portion in the generally rounded bottom portion of the cut-outs. The individual interface element is thus locked from movement in a radial direction in the rotor bodies. The interface elements further have a first force absorbing surface, arranged on the trailing edge, and a second force absorbing surface, arranged on the leading edge, and interface element securing fasteners, arranged to receive the rotor bundling means for securing the interface elements to the rotor bodies.

13 Claims, 15 Drawing Sheets

INTERFACE ELEMENTS FOR SHREDDER MILLS

BACKGROUND OF THE INVENTION

1. Field of the Invention

This invention relates to a comminuting apparatus or shredder mill, and particularly to such an apparatus having grinding rotors with replaceable interface elements, such as hammers. Most particularly, the interface elements are interlockingly arranged in the rotors.

2. Description of the Prior Art

Traditionally, hammer mills having replaceable hammers use either one or more anchoring pins to directly secure the hammer to the rotor, see for example U.S. Pat. No. 5,484,111 (Dorscht et al.), U.S. Pat. No. 4,077,573 (Kersey et al.) or U.S. Pat. No. 5,114,985 (Inui), or use a system of clamping blocks and wedges to secure the hammer to a cutout in the rotors, see for example U.S. Pat. No. 5,320,292 (Smith).

The traditional hammer mills all share a number of apparent disadvantages and drawbacks. When the hammers get worn, it is complicated, and therefor expensive, to replace or repair this structure because either the anchoring pins or anchoring pin cover plates will have to be removed separately for each hammer to be replaced, which will pose accessibility problems when multiple rotor plates or bodies are used together, or retainers holding the clamping blocks will have to be removed to give access to the clamping blocks, with the associated problems regarding dis-assembly of the multi-piece clamp and wedge construction. Long hammer support rods are often damaged or worn, and are difficult to remove.

SUMMARY OF THE INVENTION

It is an object of the invention to mitigate and/or obviate the above mentioned disadvantages and drawbacks to provide a comminuting apparatus having interchangeable interface elements, which is easy and cheap to manufacture, assemble and service, and which provides the required shredding capacity.

One object of the invention is to provide an interchangeable interface element mounting system for the rotor, which allows the interchangeable interface elements to be easily removed, when wanted, but which provides large load carrying surfaces for the interface between interchangeable interface element and rotor body.

A further object of the invention is to provide multiple rotor bodies, which are easily joined to form rotating rolls having a plurality of axially and radially spaced interchangeable interface elements.

Still a further object of the invention is to provide a comminuting mill utilizing rotor bodies with easily replaceable interchangeable interface elements.

Yet a further object of the invention is to provide solid rotor bodies and interface elements, to increase the rotating mass factor and thus the potential energy of the system.

In the invention, an interchangeable and interlocking interface element and rotor assembly for rotary hammermills, comprises at least two rotor bodies, a plurality of interchangeable interface element mounting cut-outs arranged substantially radially in the at least two rotor bodies and a plurality of peripheral mounting holes arranged to receive rotor body bundling means to hold the at least two rotor bodies fixedly against each-other and to prevent the plurality of interchangeable interface elements to exit from the interchangeable interface element mounting cut-outs, and a plurality of interchangeable interface elements arranged to be mountable in the interchangeable interface element mounting cut-outs. Each of the plurality of interchangeable interface elements have a substantially oblong and planar shape, a bottom end shaped to interlock with the interchangeable interface element mounting cut-outs, a leading edge facing the direction of rotation of the rotors, a trailing edge facing the side opposite to the direction of rotation, and interchangeable interface element tip mounting means, arranged in an upper mounting portion of each plurality of interchangeable interface elements. The interchangeable interface elements further have a bottom portion with a generally rounded surface arranged to cooperate with a generally rounded bottom portion of the interchangeable interface element mounting cutouts, a heel portion facing the direction of rotation and shaped to cooperate with a recess portion of the interchangeable interface element mounting cutouts so that during insertion of an individual interchangeable interface element in one interchangeable interface element mounting cut-out, by inserting the bottom portion first, the generally rounded surface is slidable into a relief recess portion of the interchangeable interface element mounting cut-outs, permitting the heel portion to clear the protruding portion and the interchangeable interface element to be seated with the bottom portion in the generally rounded bottom portion of the interchangeable interface element mounting cut-outs locking the individual interchangeable interface element from movement in a radial direction in the at least two rotor bodies, the plurality of interchangeable interface elements further having a first force absorbing surface, arranged on the trailing edge, and a second force absorbing surface, arranged on the leading edge, and interchangeable interface element securing fasteners, arranged to receive the rotor bundling means for securing the plurality of interchangeable interface elements axially to the at least two rotor bodies.

The rotors preferably have a substantially cylindrical outer edge, but alternatively could be square, hexagon shaped or similar.

The rotor bundling means preferably comprise rotor bolts and rotor nuts.

The at least two rotor bodies are preferably fixably arranged on a rotatable common shaft running through central mounting holes in the at least two rotor bodies.

The at least two rotor bodies are preferably attached to the rotatable shaft using a pair of conical bushings arranged to clamp the rotatable shaft to the at least two rotor bodies.

The plurality of interchangeable interface elements preferably have replaceable interchangeable interface element tips arranged at an outer end of the plurality of interchangeable interface elements facing the leading edge.

The assembly may comprise interchangeable interface elements arranged in straight rows or interchangeable interface elements arranged along helical curves.

The rotatable shaft is preferably rotated by a hydraulic motor, an electric motor or an internal combustion engine.

Thus, no load carrying pins are used, the interchangeable interface element holder is instead shaped to be slidable into a cutout in the rotor and held in the cutout by a heel formed at a lower part of the interchangeable interface element holder. The heel is held by a corresponding protruding portion of the cutout.

Further features of the invention will be described or will become apparent in the course of the following detailed description.

BRIEF DESCRIPTION OF THE DRAWINGS

In order that the invention may be more clearly understood, the preferred embodiment thereof will now be described in detail by way of example, with reference to the accompanying drawings, in which.

DETAILED DESCRIPTION OF THE PREFERRED EMBODIMENT

Figure 1A:
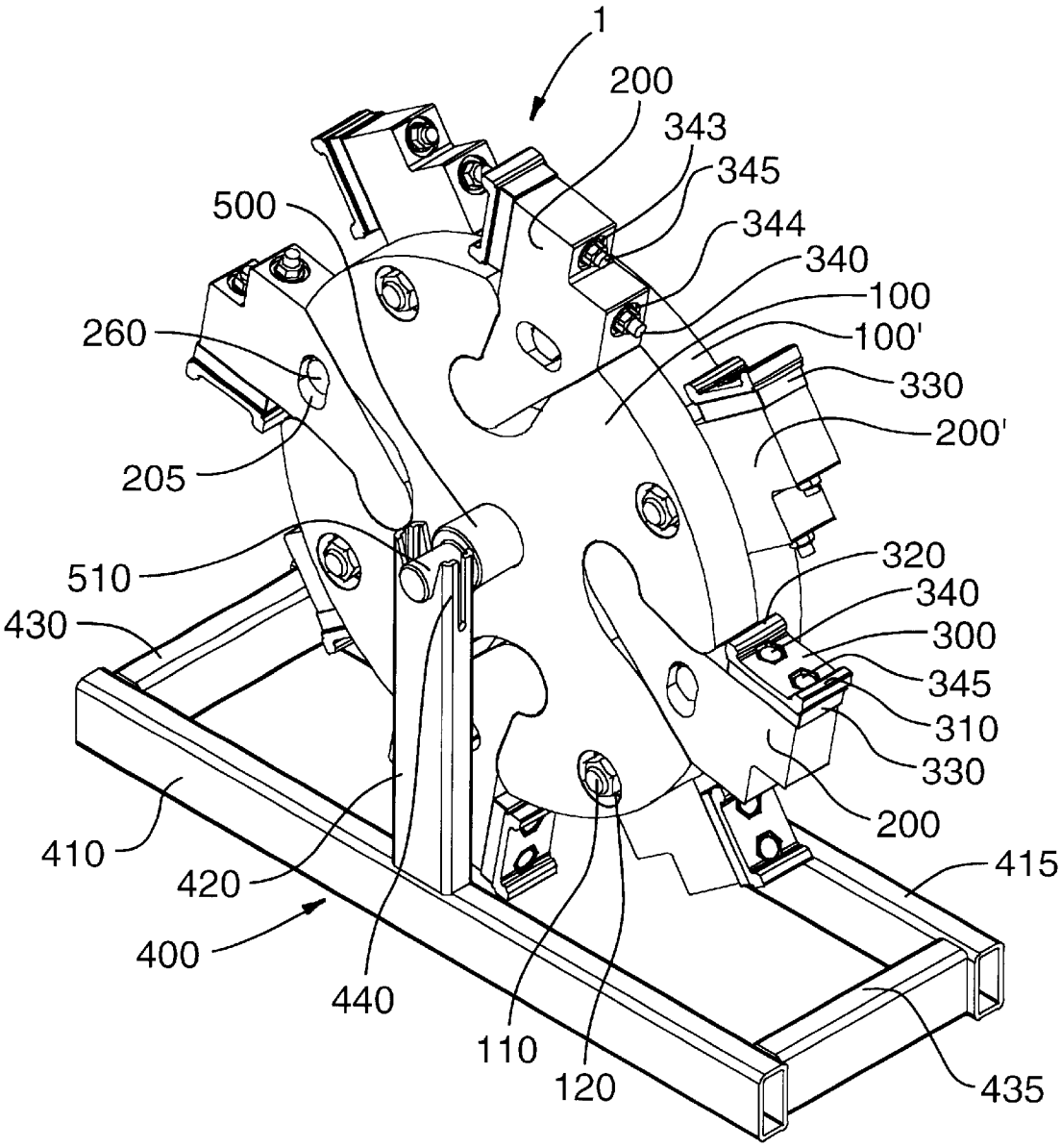
FIG. 1A is a schematic elevational perspective side view of an assembled rotor according to the invention, the rotor shown on a holding/transport stand.
Figure 1B:
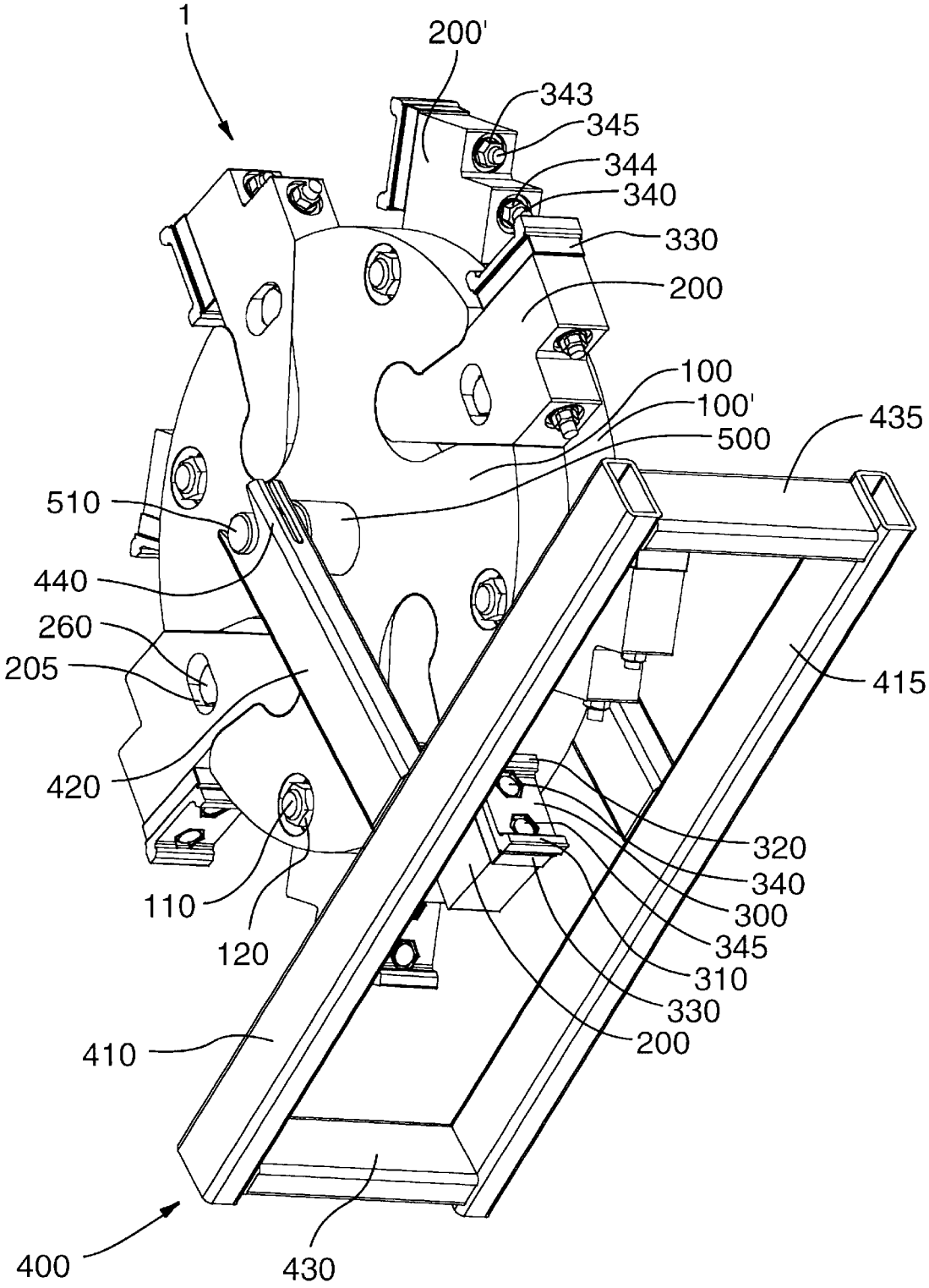
FIG. 1B is a schematic bottom perspective side view of the rotor of FIG. 1A.
Figure 2:
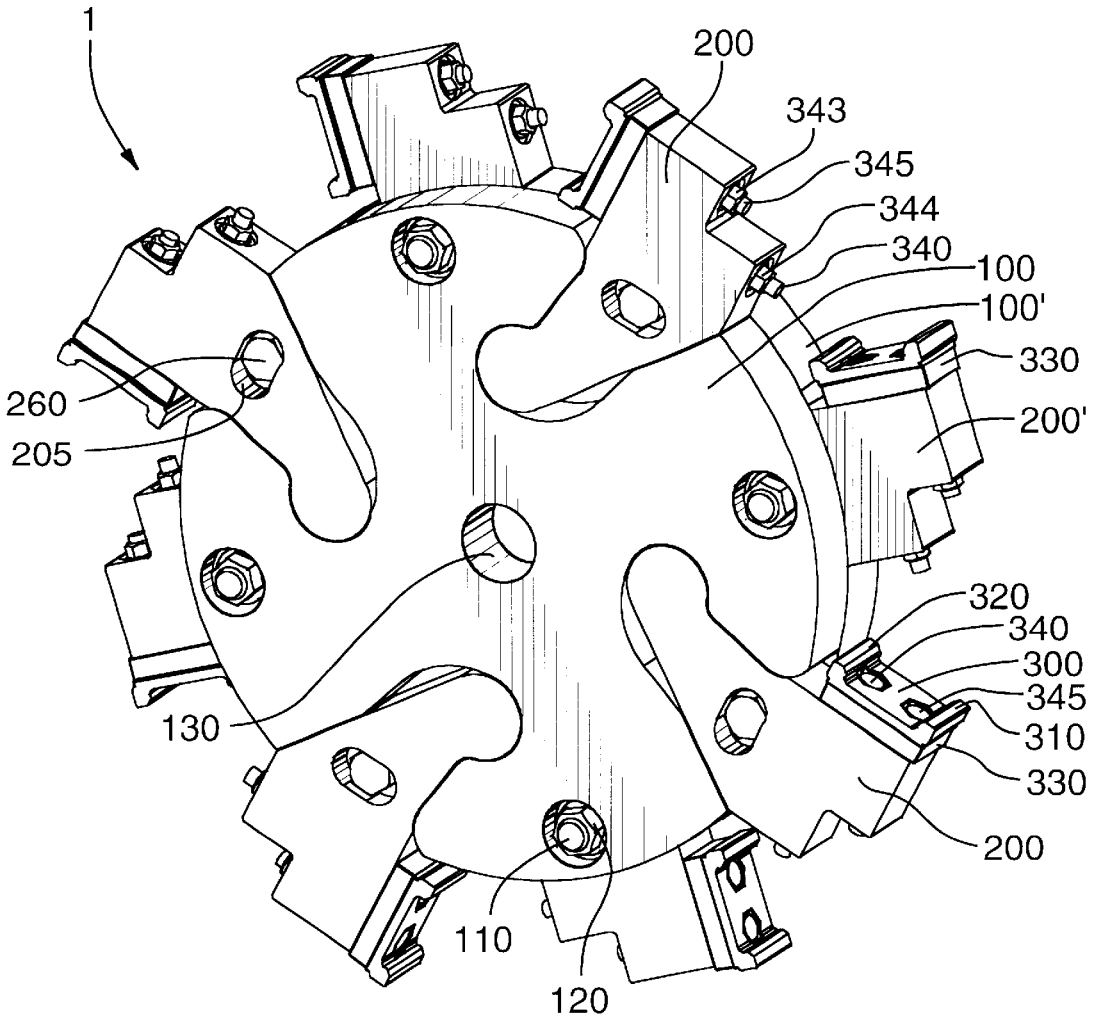
FIG. 2 is a schematic elevational perspective side view of the assembled rotor according to the invention, showing the rotor and interchangeable interface element assembly.

Referring to FIGS. 1A, 1B and 2, a rotor assembly 1 having a plurality of rotors bodies 100, 100' with a plurality of interchangeable interface elements, shown as hammers 200, 200', mounted on the rotors is shown. Advantageously, the rotor assembly has a common shaft 500, which has end mounting pins 510 and 520 (see FIG. 6), which are held in shaft holders 440 and 441 (see FIG. 7) of a stand 400, for transporting, servicing and/or storing the rotor assembly. The stand may have wheels (not shown) for easy transportation of the rotor assemblies. The rotors are fastened or bundled to each other using fasteners or bundling means, for example rotor bolts 110 and rotor nuts 120 as shown. Each hammer 200, 200' has a hammer tip 300 mounted on one side of the hammer using tip fasteners, preferably upper hammer tip bolts 345, lower hammer tip bolts 340, upper hammer tip nuts 343 and lower hammer tip nuts 344 as shown.

Figure 3A:
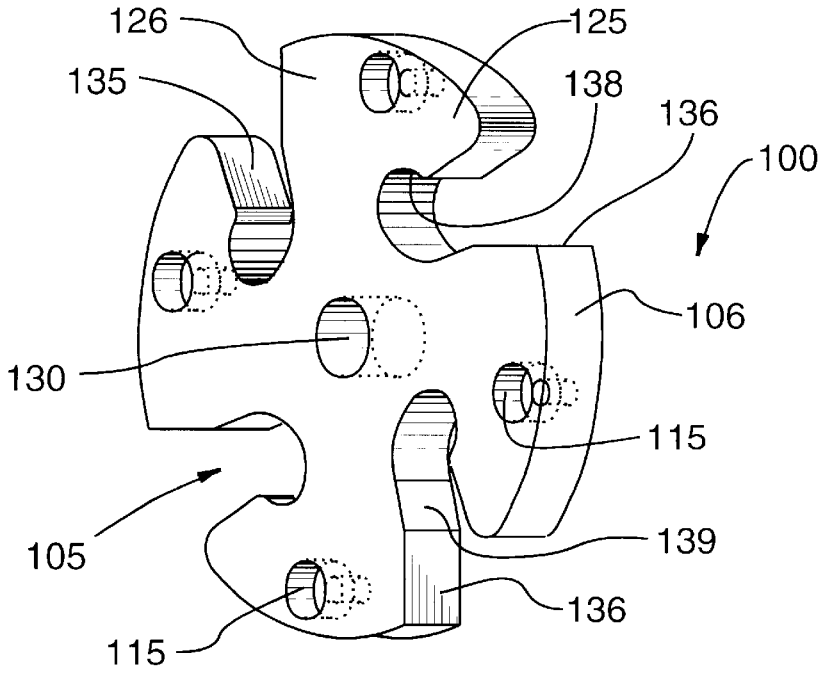
FIG. 3A is a elevational perspective side view of a rotor body according to the invention.
Figure 3B:
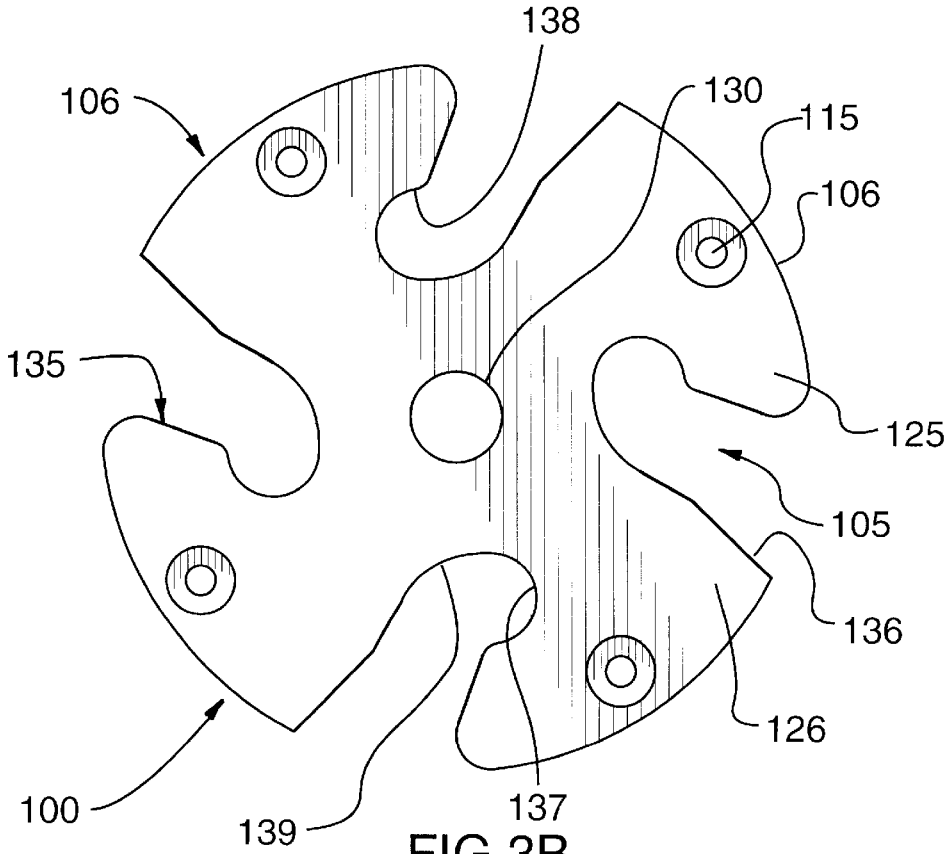
FIG. 3B is a side view of the rotor body according to FIG. 3A.

Each rotor has a rotor body 100, as shown in detail in FIGS. 3A and 3B, having a substantially circular circumference 106. A plurality of cutouts 105 are arranged radially in the body for receiving hammers (not shown). A central hole 130 is arranged in the body 100 to receive the common shaft of the rotor assemblies. Further, hammer mounting holes 115 are arranged to axially hold hammers of an adjacent rotor body, when the rotor body is fastened to at least one further rotor body 100' (see FIG. 2). Thus, the minimum number of rotor bodies used to form one rotor assembly 1 is two. The maximum number of rotor bodies used is dictated by available space and the actual application in which the rotor assembly is being used. Each cutout 105 has a first side 135, facing the direction of rotation of the rotor when in use, a second side 136, facing the opposite direction to the direction of rotation, and a generally rounded bottom portion 137, which ends in a protruding portion 138 for retaining the hammer in the cutout during rotation of the rotor (as described in more detail below). The shape of the cutout generally conforms to the outer shape of a hammer 200, 200', which will be described in more detail later, except for a portion of the second side 136, which has a relief recess portion 139, which allows the insertion of the hammer into the cutout.

Figure 4B:
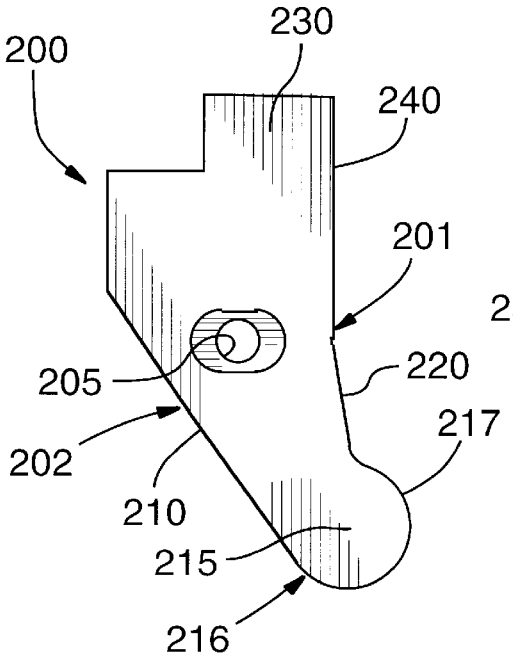
FIG. 4B is a side view of the interchangeable interface element of FIG. 4A.
Figure 4A:
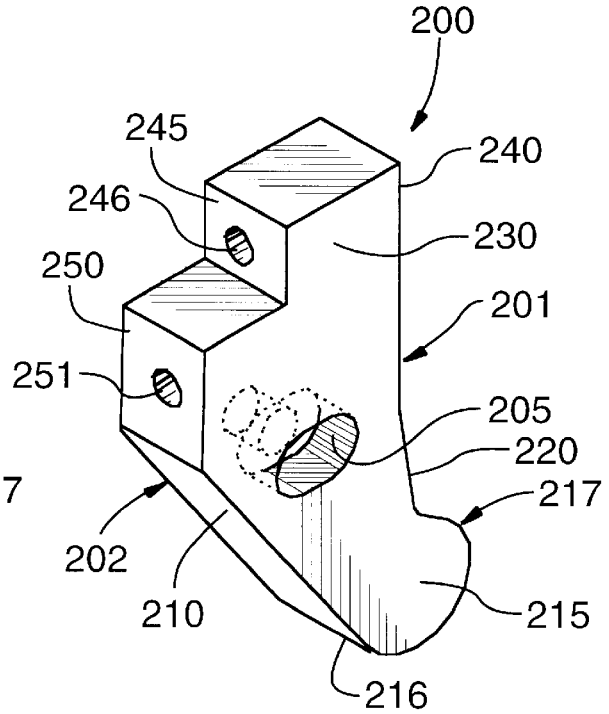
FIG. 4A is an elevational perspective side view of an interchangeable interface element according to the invention, showing the interchangeable interface element from the side facing backwards compared to the direction of rotation and without a mounted interchangeable interface element tip.

As is shown in FIGS. 4A and 4B, a first embodiment of a hammer 200 has a third side 201, facing the direction of rotation of the rotor when the hammer is installed in a rotor and the rotor is in use, a fourth side 202, facing the opposite direction to the direction of rotation, and a bottom portion 215 having a generally rounded surface 216, which is arranged to cooperate with the generally rounded bottom portion 137 of the cutout 105. The bottom portion of the hammer has a force absorbing heel portion 217 facing the direction of rotation as specified earlier, the heel portion being shaped to cooperate with the recess portion 138 of the cutout to lock the hammer movement in a radial direction in the rotor body 100. The first embodiment of hammers 200 further has a first force absorbing surface 210, arranged on the fourth side 202 of the hammer, and a second force absorbing surface 220, arranged on the third side 201 of the hammer. The hammer is preferably generally wedge-shaped, with a wide portion 230 outwards from the rotor body and the narrow portion inwards and terminating in the bottom portion 215. At the wide portion of the hammer, adjacent the impact end 240 of the hammer, hammer tip 300 upper mounting means 246 are arranged in an upper mounting portion 245 of the hammer, facing the intended impact direction of the hammer. Preferably, arranged in a lower mounting portion of the hammer at the wide portion of the hammer are hammer tip 300 lower mounting means 251. The upper and lower mounting means are, for example but not exclusively, bolt holes, mounting profiles, threaded holes, other holes etc. As described in conjunction with FIG. 1A, the preferred fastening means for the hammer tips are bolts and nuts, but any suitable fastener may be used, such as rivets, mounting rails with locking screws, bolts threaded into threaded holes, welding or brazing the tip directly to the hammer, etc. The first embodiment of hammers 200 further has a hammer securing fastener 205, preferably a hole with a recess for a bolt head (as shown). The rotor bolts 110 are arranged to be inserted in the hammer securing fastener for securing the hammer to the rotor body assembly, as will be described later.

Figure 4C:
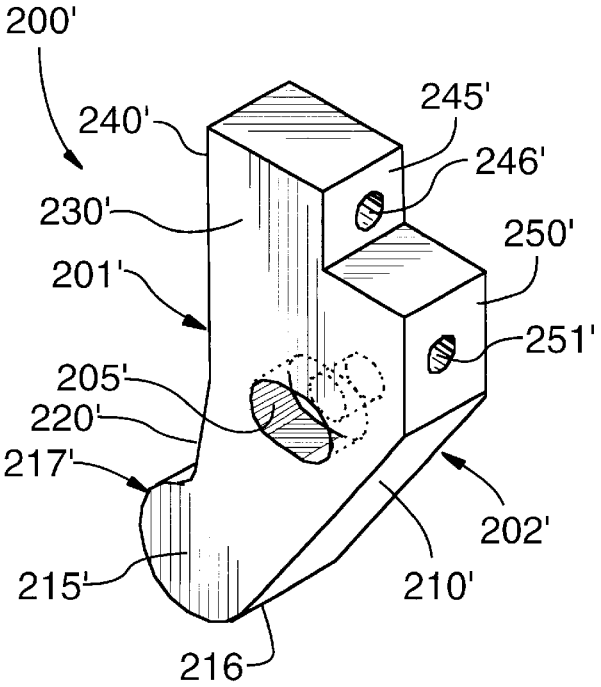
FIG. 4C is an elevational perspective side view of a further interchangeable interface element according to the invention, showing the further interchangeable interface element from the side facing backwards compared to the direction of rotation and without a mounted interchangeable interface element tip.
Figure 4D:
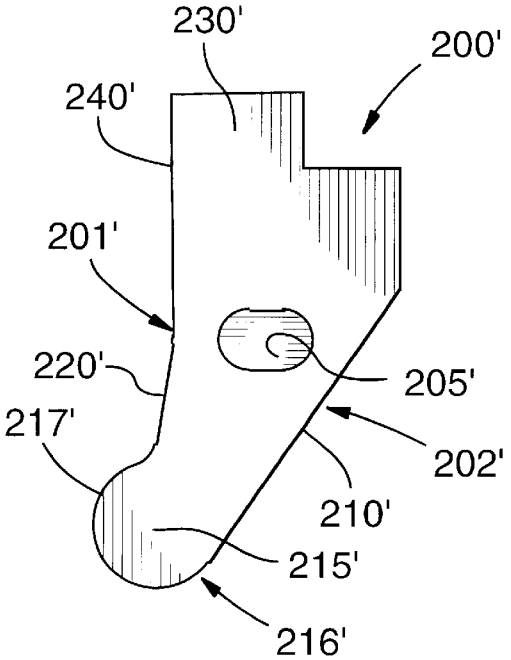
FIG. 4D is a side view of the further interchangeable interface element of FIG. 4C.

Depending upon which rotor body the hammer is to be mounted on, there are two embodiments of hammers: a first embodiment 200 described above, and a second embodiment of hammers 200'. The second embodiment of hammers are shown in FIGS. 4C to 4D, and are identical to the first embodiment of hammers 200, except for the hammer securing fastener 205' which is arranged to be accessed from the opposite side of the hammer, compared to the first embodiment of hammers. In this way, the hammers of the outermost rotor bodies of a rotor are chosen so that the hammer securing fastener 205,205', respectively, permit the easy manipulation of the rotor bolts 110 and rotor nuts 120. In FIGS. 4C to 4D, the reference numerals used are the same as for FIGS. 4A to 4B for similar technical features, except that a "prime" designation has been added. For example, the force absorbing heel portion of a first embodiment hammer 200 has the designation 217, whilst the force absorbing heel portion of a second embodiment hammer 200' has the designation 217'.

Figure 5:
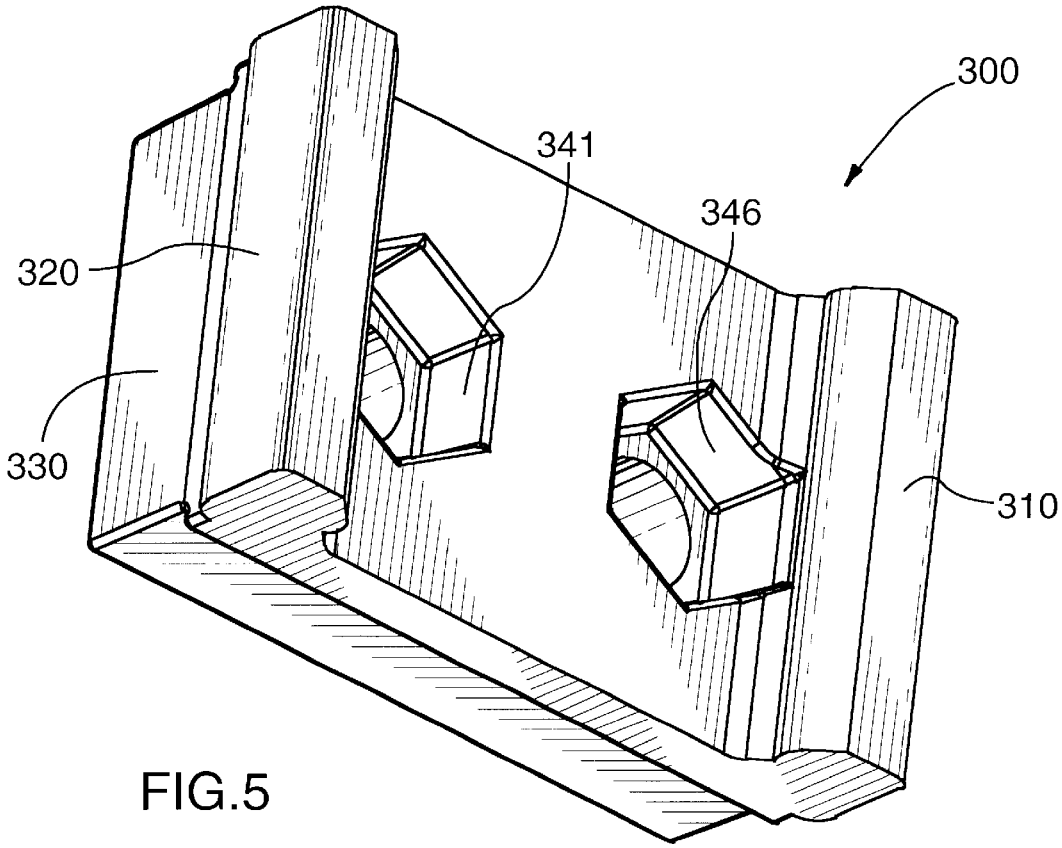
FIG. 5 is an elevational perspective side view of a interchangeable interface element tip according to the invention.

In FIG. 5, one embodiment of a hammer tip 300 is shown. The actual shape of the hammer tip is not critical to the invention, but is dictated by the desired shredding performed (type of material to be shredded, capacity, cost etc.). The hammer tip 300 according to the preferred embodiment is substantially rectangular in shape, having a first ridge 310, facing the direction of rotation of the rotor when the hammer tip is fastened onto a hammer, which, in turn, is inserted into a cutout of a rotor body. Further, a second ridge 320 is arranged at an end of the hammer tip opposite to the end having the first ridge 310. The first and second ridge are the areas of the hammer tip which first contact the material to be shredded, when the shredder is in use. Further, a flat backing plate portion 330 of the hammer is arranged behind the hammer tip 300. The hammer tip 300 further preferably has a first mounting hole 341 and a second mounting hole 346, for attaching the hammer tip to the upper mounting means of the hammer and the lower mounting means 251 of the hammer, respectively, in the preferred embodiment. The hammer tip mounting method of course depends on the arrangement of the tip mounting means on the hammer, and vice-versa.

Figure 6:
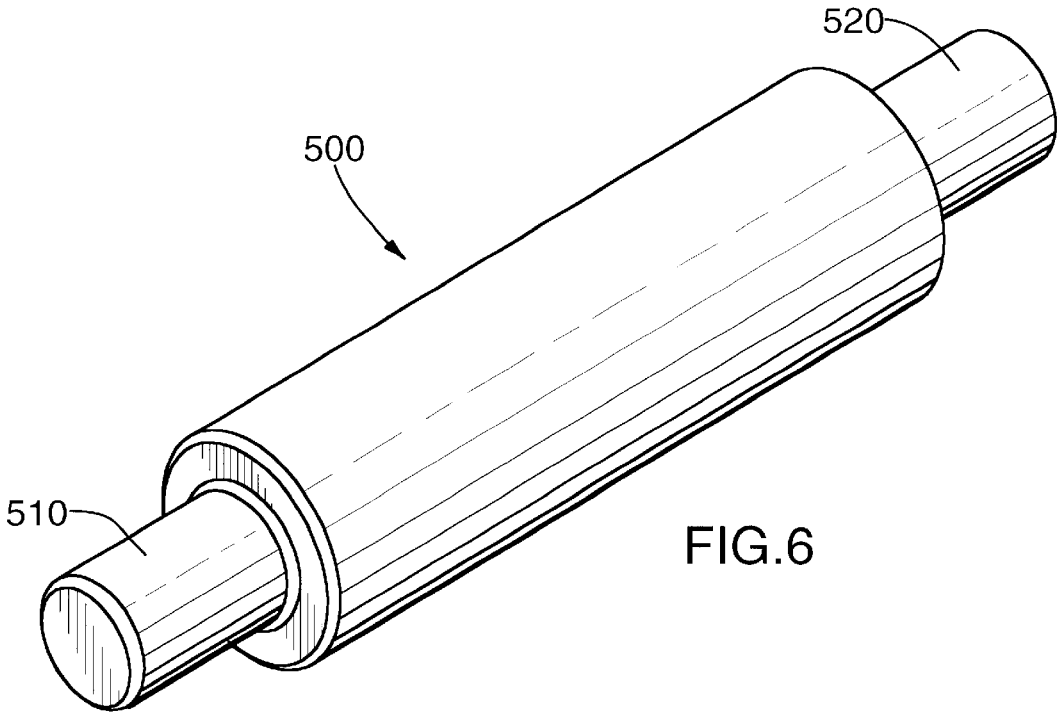
FIG. 6 is an elevational perspective side view of a transport shaft according to the invention.
Figure 7:
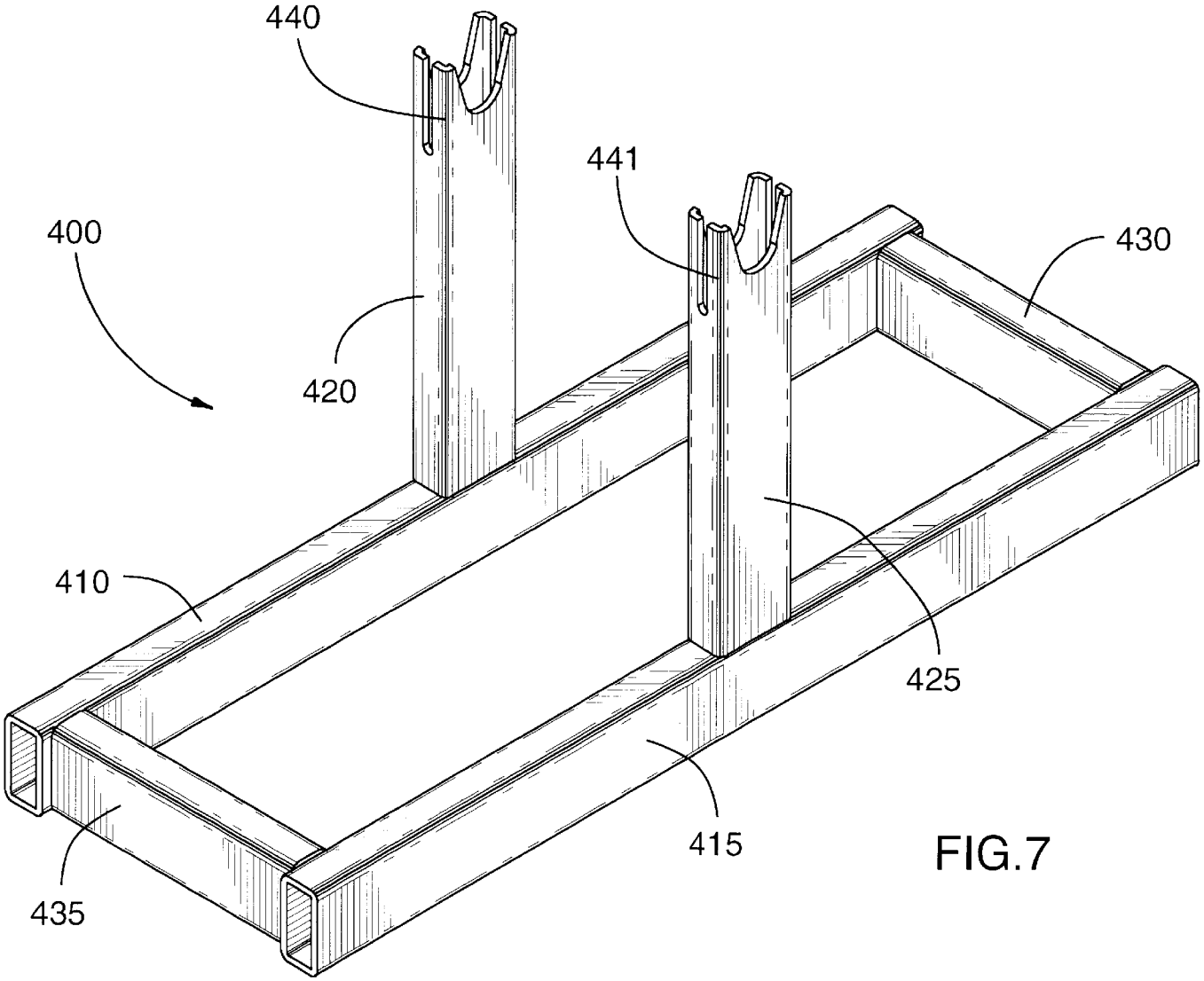
FIG. 7 is an elevational perspective side view of the holding/transport/service stand according to FIG. 1A.

FIG. 6 shows the common shaft 500, used as a drive shaft/storage shaft, for mounting at least two rotor bodies, with or without attached hammers. The shaft has a first end 510 and a second end 520, preferably shaped as mounting pins for cooperation with a first shaft mount 440 and a second shaft mount 441 of the stand 400, used to store or transport a rotor assembly (rotor bodies with or without hammers mounted on a common shaft). The stand preferably has a substantially rectangular frame having a first side 410, a second side 415, a first end 430 and a second end 435. The first shaft mount 440 is arranged at a top of a first leg 420, arranged vertically on the first side 410, and the second shaft mount 441 is arranged at a top of a second leg 425, arranged vertically on the second side 415.

When inserting a hammer 200 in a cutout 105, the bottom portion 215 of the hammer is inserted first, and the generally rounded surface 216 of the hammer is slid into the relief recess portion 139 of the cutout. This action permits the heel portion 217 of the hammer to clear the protruding portion 138 of the cutout and the hammer to be seated with the bottom portion in the generally rounded bottom portion 137 of the cutout. The rotor bodies 100, 100' (see FIG. 1A), respectively, are then secured to each other by inserting the rotor bolts 110 into the hammer securing fastener 205 of one rotor and into the hammer mounting holes 115 of an adjacent rotor. Rotor nuts 120 are thereafter tightened onto the rotor bolt end opposite the head of the rotor bolt, to securely hold the hammers in position in their respective cutouts. During use, virtually no force is transmitted from the impact of the hammer heads on the material to be shredded to the rotor bolts 110, substantially all the force is absorbed by the interfaces between the aforementioned third and fourth sides 201, 202, respectively, of the hammers 200, and the cutouts 105 of the rotor bodies 100, 100'. Thus, the rotor bolts are not easily deformed, broken or worn during operation of the rotor for shredding material.

After insertion, the hammer 200 is prevented from being flung out of the cutout 105 by the heel portion 217 of the hammer being held by the protruding portion 138 of the cutout, as previously described. When a hammer 200 is worn, necessitating replacement, the rotor bolt 110 holding the hammer in question is loosened, whereby the hammer can be slid out of the cutout 105, by sliding the generally rounded surface 216 of the hammer via the relief recess portion 139 of the cutout. This action permits the heel portion 217 of the hammer to clear the protruding portion 138 of the cutout and the hammer can be removed from the cutout, without having to disassemble the rotor assembly further, saving both time and money for the shredding operator.

Figure 8A:
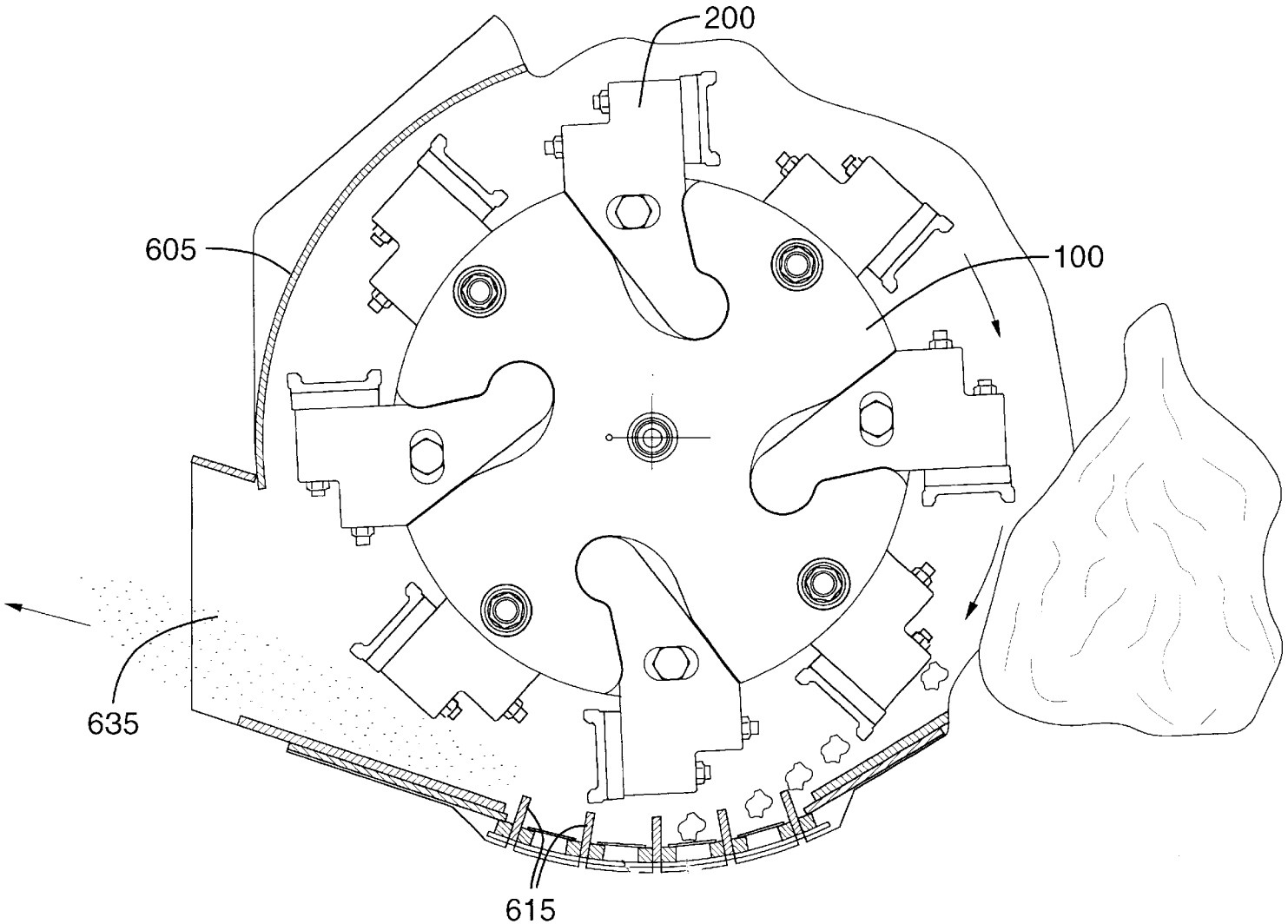
FIG. 8A is a side view of a comminuting mill having a plurality of rotor assemblies according to the invention, showing the use of bars for comminuting and holding the material to be shredded for impact with the interchangeable interface elements.

FIG. 8A shows an embodiment of a comminuting mill according to the invention, where the rotor assembly is arranged inside a housing 605. The housing has an inlet for material to be comminuted and bars 615 for breaking up the material further. All pieces go out through an outlet 635.

Figure 8B:
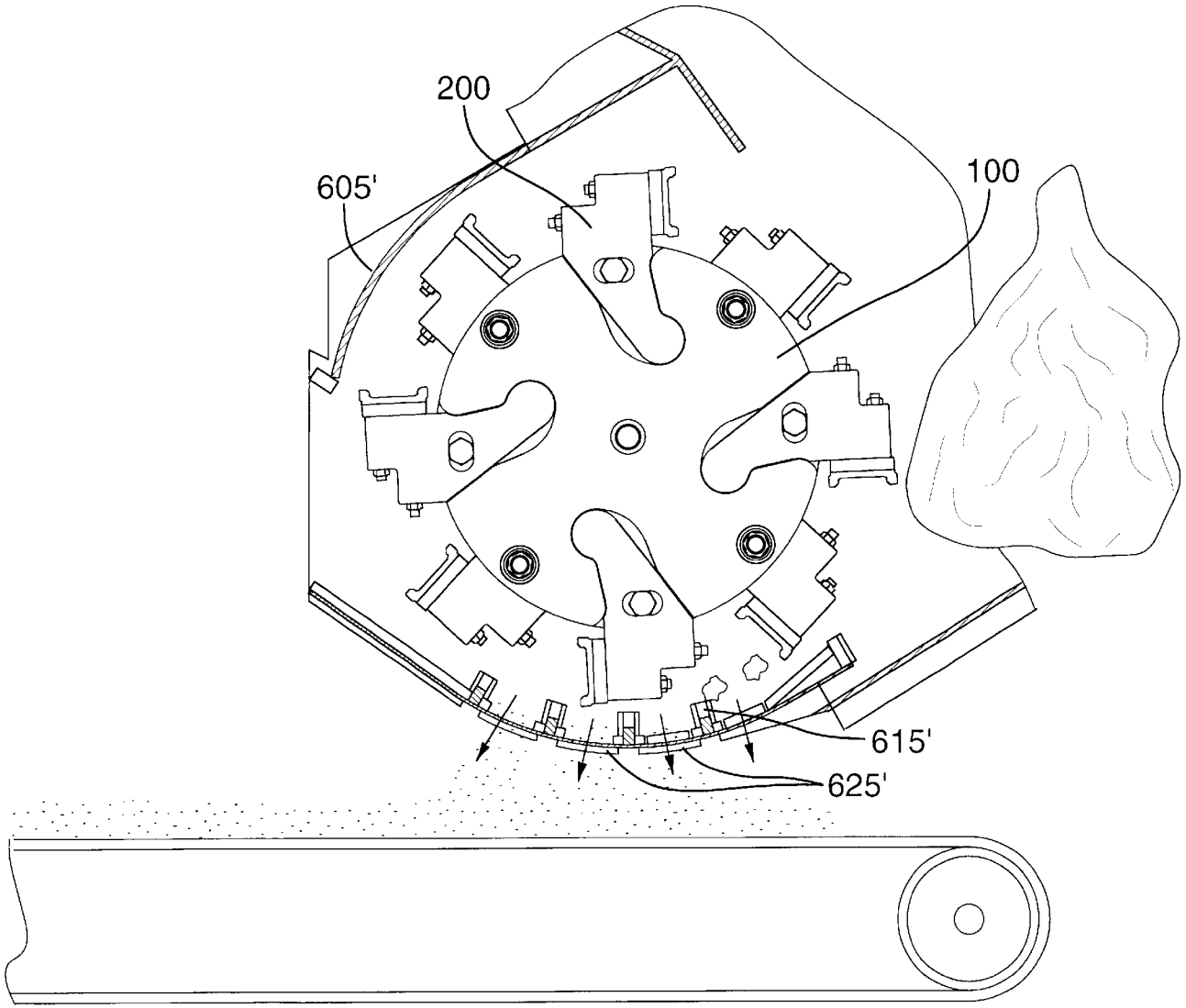
FIG. 8B is a side view of a comminuting mill having a plurality of rotor assemblies according to the invention, showing the use of a grid for screening and holding the material to be shredded for impact with the interchangeable interface element.

FIG. 8B shows a further embodiment of a comminuting mill according to the invention, where the rotor assembly is arranged inside a housing 605'. The housing has an inlet for material to be comminuted and a screening means comprising frames 615' and screened openings 625' arranged between the frames. The pieces go out through the screened openings 625' and onto a conveyor 665.

Figures 9, 9A:
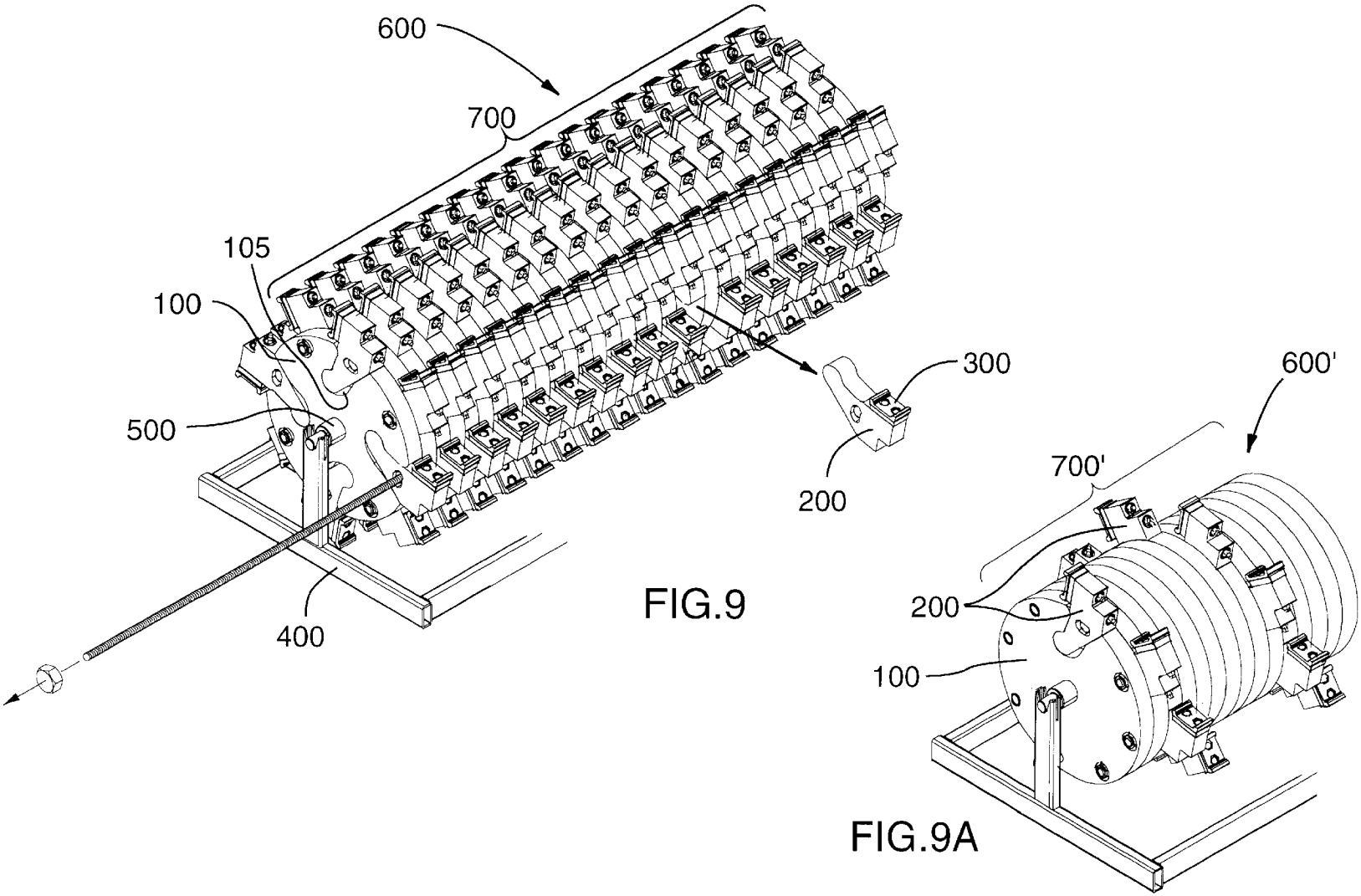
FIG. 9 is an elevational side view of a plurality of rotor assemblies according to the invention, showing one rotor bolt and one interchangeable interface element removed.
FIG. 9A is an elevational side view of a plurality of rotor assemblies according to the invention, showing how the interchangeable interface elements of one embodiment are arranged in a helical pattern.
Figure 10:
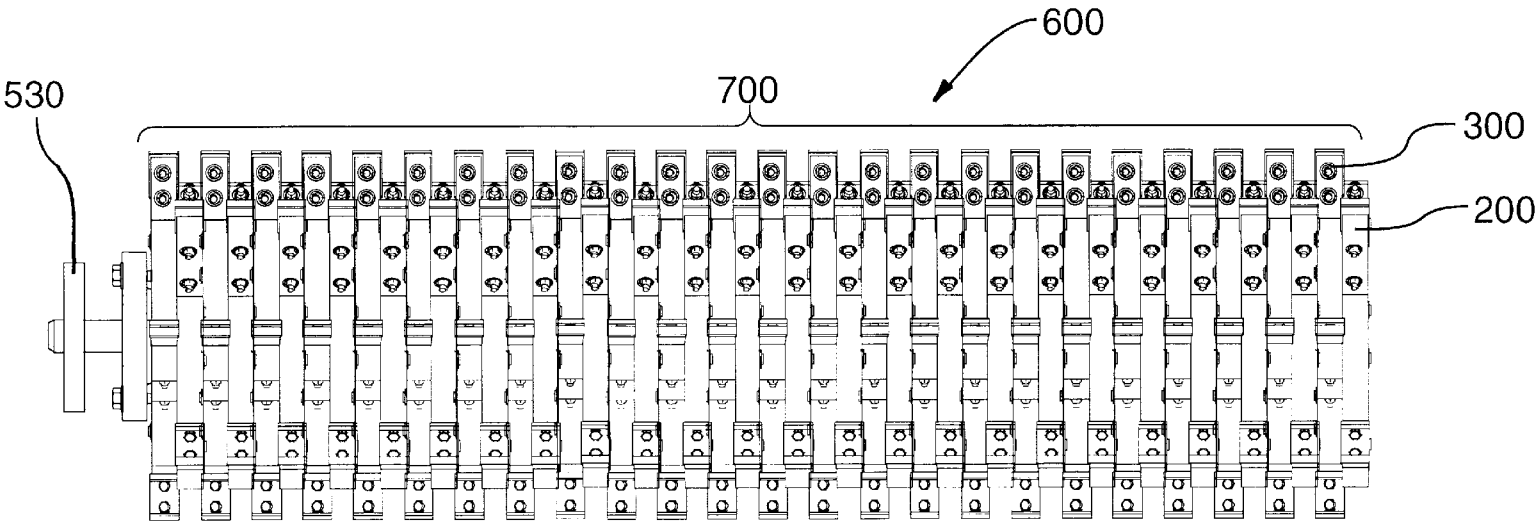
FIG. 10 is a side view of a plurality of rotor assemblies according to the invention.

In FIGS. 9, 9A and 10, an assembled rotor 600 is shown comprising a plurality of rotor bodies 100 arranged on a common shaft 500. Each rotor body is rotated a certain angle, with respect to its neighbouring rotor body, to allow hammers 200 inserted in the cutouts 105 to protrude from the rotor 600 at alternating positions axially along the rotor.

In this way, the access to each individual hammer is enhanced, at the same time as the efficiency of the rotor for shredding purposes is maintained. Thus, rows of hammers 700 are formed, individual hammers being held by every other rotor body of the assembled rotor for each particular row of hammers. In FIG. 10, a rotor drive means 530 is shown, removably but securely attached to the common shaft 500 at either end mounting pin 510, 520, respectively. The rotor drive means is preferably a belt pulley (most preferably a multi-belt pulley), or a cogged wheel for making contact with a drive pinion, or a splined flange with the splines arranged on its face for making contact with a drive wheel. The power to the rotor might be provided by a hydraulic drive, an electric motor or a mechanical drive unit, such as an internal combustion engine.

Figure 11:
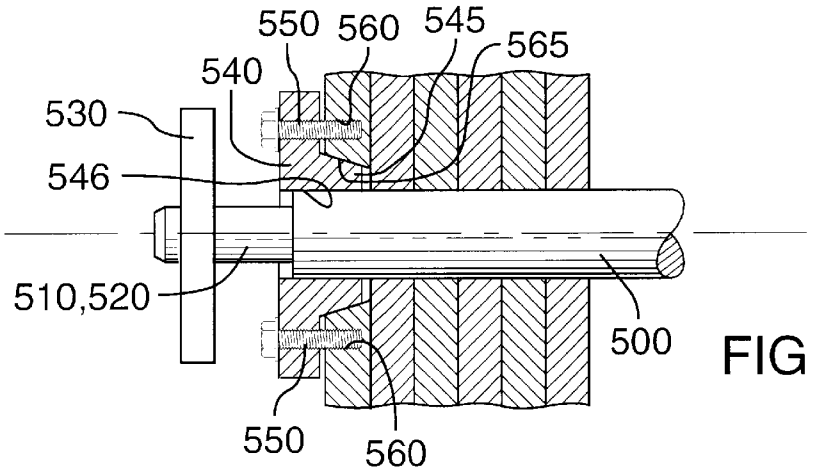
FIG. 11 is a partially sectioned side view of a rotor drive according to one embodiment of the invention.
Figure 12:
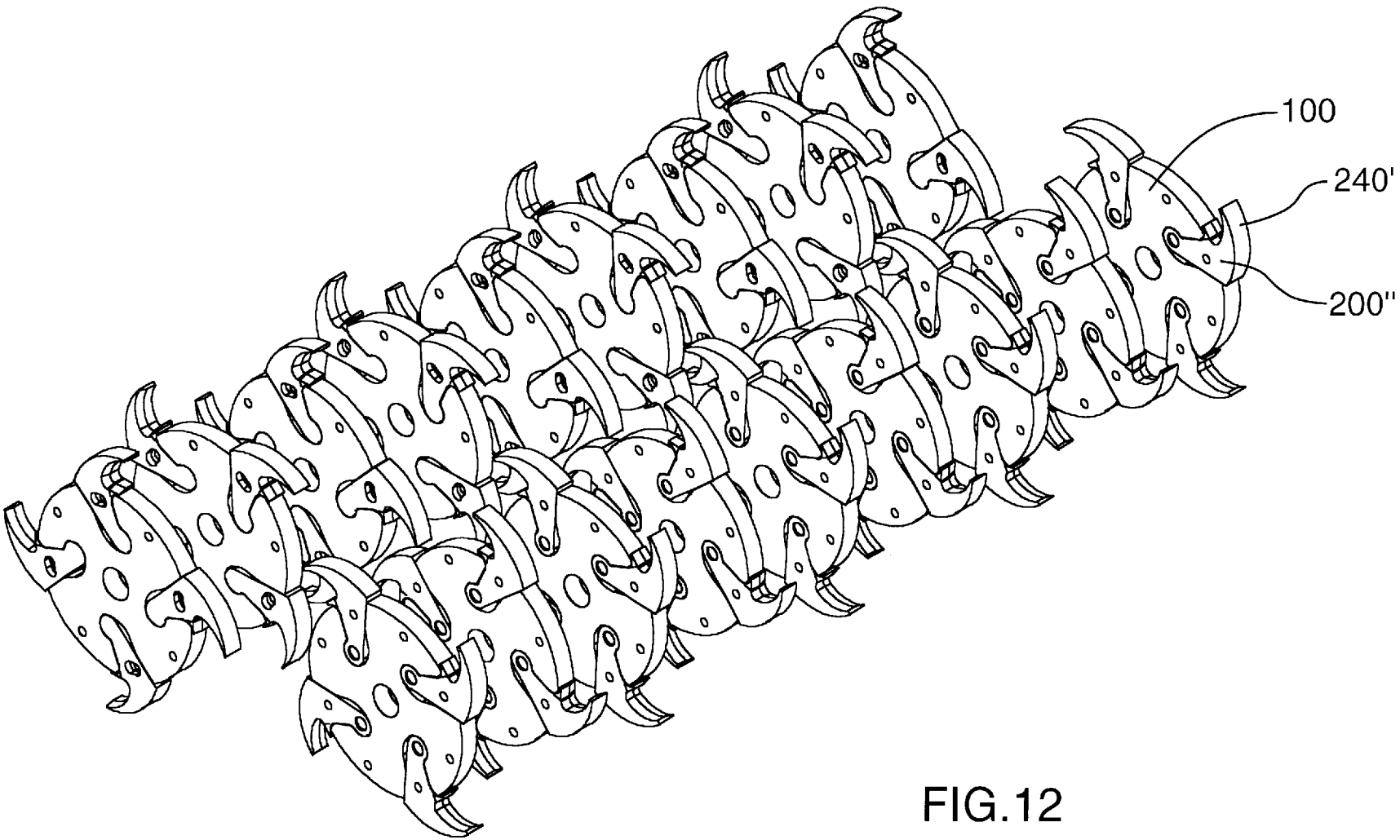
FIG. 12 is an elevational side view of a plurality of rotor assemblies according to a further embodiment of the invention, showing interchangeable interface elements in the shape of knives.
Figure 13:
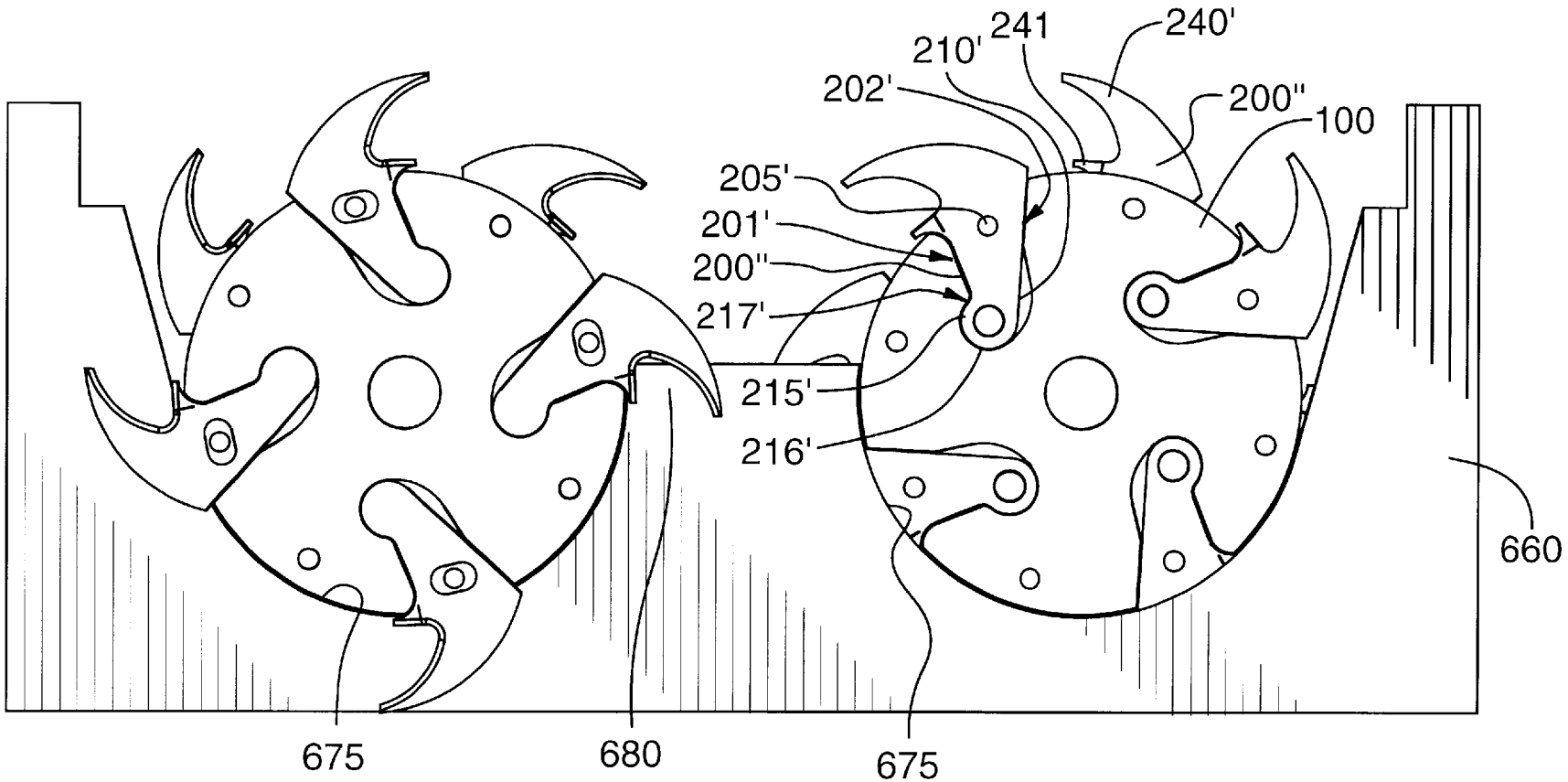
FIG. 13 is a side view of a shredding apparatus according to an embodiment of the invention, having rotor assemblies arranged in a housing, the rotors using the interface elements as shown in FIG. 12.
Figure 14:
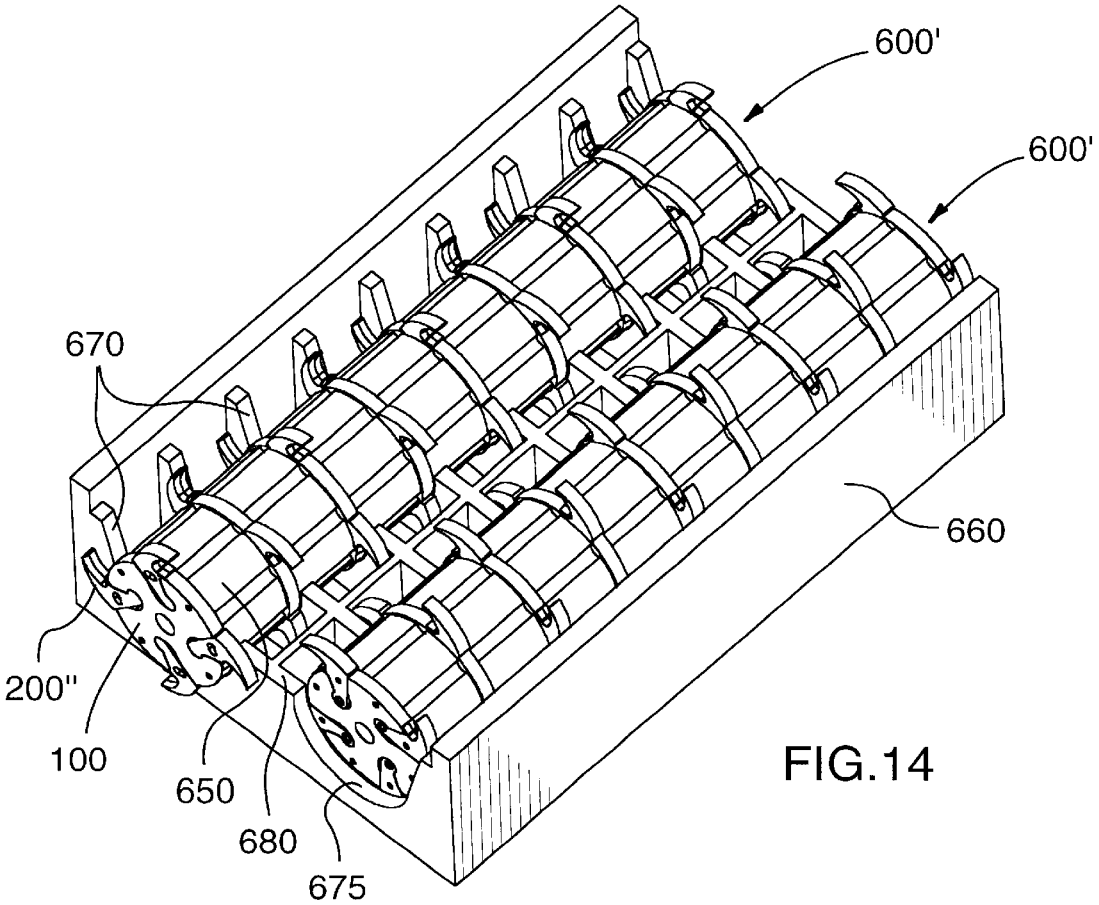
FIG. 14 is an elevational side view of the shredding apparatus of FIG. 13.
Figure 15:
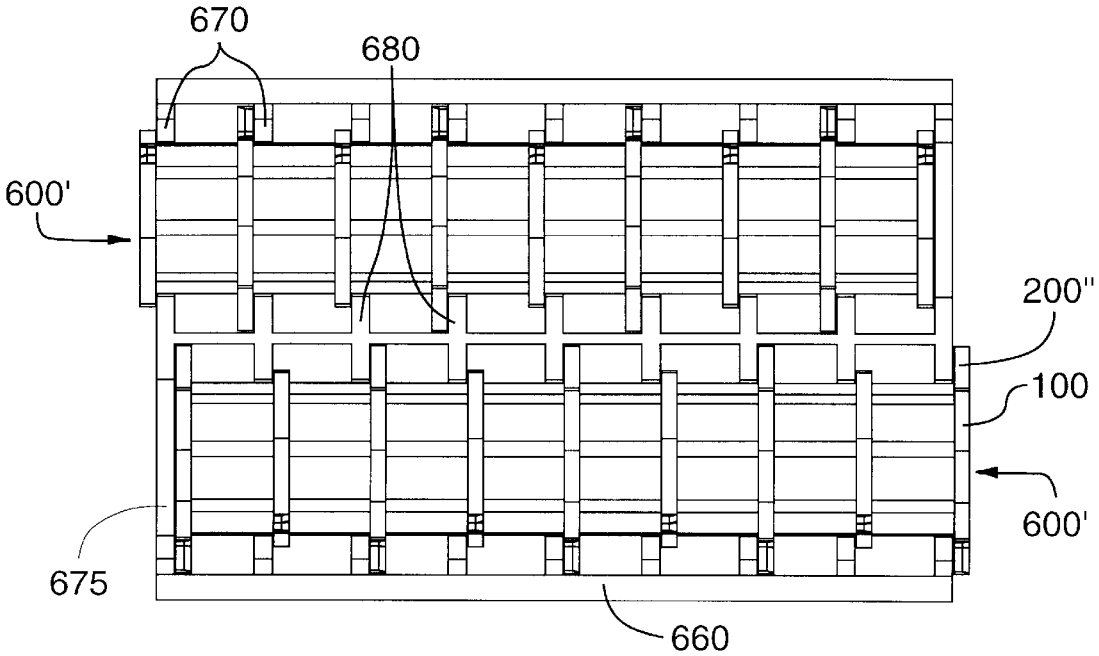
FIG. 15 is a top view of the shredding apparatus of FIG. 13.

The attachment of the common shaft 500 to a rotor is preferably accomplished by attaching a conical bushing 540 to each end rotor body of a rotor, as shown in FIG. 11. The conical bushing has a conical protrusion 545 and a central hole 546, having a diameter which allows the conical bushing to be slidably fit over the common shaft 500. A conical hole 565, arranged either in each end rotor body or in a separate end piece fastenable to the end rotor body, is shaped to cooperate with the conical protrusion 545. The conical bushing 540 further has fasteners 550 to securely fasten the conical bushing to fastening holes 560 in either the end rotor body or the separate end piece fastenable to the end rotor body. By fastening the conical bushing, the conical protrusion will be clamped in the conical hole and thus be pressed onto the common shaft, to securely clamp the common shaft to the conical bushing (and therewith to the rotor).

An alternative configuration of the hammers 200 of a rotor 600' is shown in FIG. 9A. Here, each hammer of a row of rotors 700' is rotated a certain angle with respect to the hammers of an adjacent rotor body 100, to form helical shaped rows of hammers. In this way, the efficiency of the shredding operation is enhanced, because the number of hammer hits per time unit is higher: each hammer hits the material to be shredded in sequence as opposed to simultaneously for the previous embodiment having straight rows of hammers. The embodiment is shown as having one hammer per rotor body, but any suitable number of hammers may be used per rotor body, to achieve a certain capacity of the comminuting mill etc.

A third embodiment of the interchangeable interface elements 200" of the invention are shown in FIGS. 12 to 15. The interchangeable interface elements have an impact end 240' shaped like a knife, for cutting the material to be comminuted. The knife impact end cooperates with first shear surfaces 680 and second shear surfaces 670, arranged in a housing 660 for holding the rotor assemblies 600' of a comminuting mill according to a further embodiment of the invention, see FIGS. 14 and 15. The housing further has bearing surfaces for holding the rotor assemblies in a rotatable way. In each rotor assembly 600', the rotor bodies 100 are assembled with distance elements 650 between two rotor bodies, to widen the area of interface element action.

Figure 16:
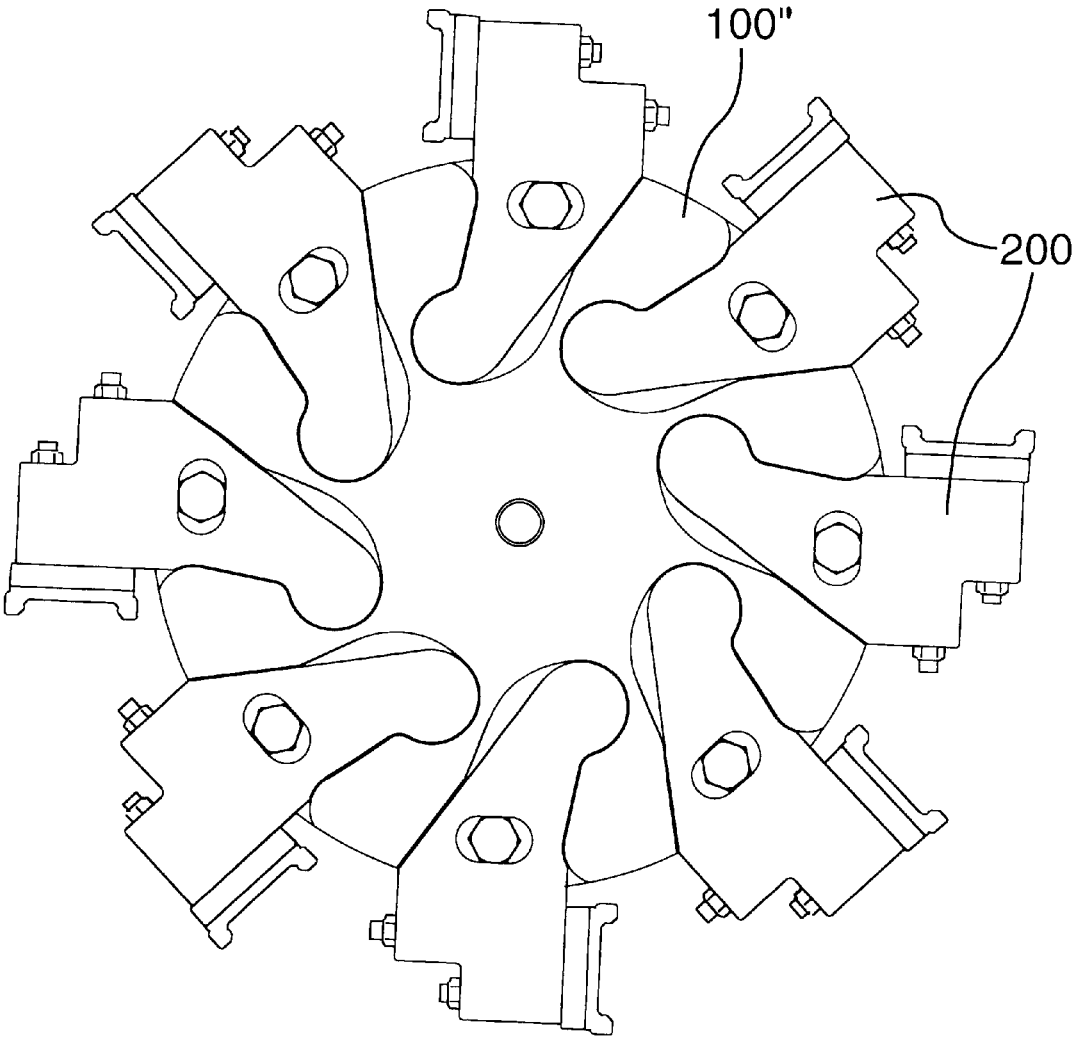
FIG. 16 is a side view of a rotor body having eight interchangeable interface elements.

It will be appreciated that the above description relates to the preferred embodiment by way of example only. Many variations on the invention will be obvious to those knowledgeable in the field, and such obvious variations are within the scope of the invention as described and claimed, whether or not expressly described. For example, the rotor bodies are shown having 4 cutouts, but any suitable number of cutouts may be used, ranging from 1 to a number dictated by the diameter of the rotor with respect to the size and dimensions of the interface elements used, see FIG. 16, where 8 interface elements 200 are arranged in one rotor body 100'. Also, the number of rotor bodies used to form a rotor assembly is shown as either 2, 34 or 48, but any suitable number of rotor bodies can be assembled to perform the required shredding operation. One standard size rotor assembly would be 24 rotor bodies wide, for example.

What is claimed as the invention is:

1. An interlocking interchangeable interface element and rotor assembly for rotary commuting mills, comprising:

at least two rotor bodies, a plurality of interchangeable interface element mounting cut-outs arranged substantially radially in said at least two rotor bodies and a plurality of peripheral mounting holes arranged to receive rotor body bundling means to hold said at least two rotor bodies fixedly against each-other and to prevent said plurality of interchangeable interface elements to exit from said interchangeable interface element mounting cut-outs, and a plurality of interchangeable interface elements arranged to be mountable in said interchangeable interface element mounting cut-outs, each of said plurality of interchangeable interface elements having:

a substantially oblong and generally flat shape having parallel flat sides;

a bottom end shaped to interlock with said interchangeable interface element mounting cut-outs;

a leading edge facing the direction of rotation of the rotors;

a trailing edge facing the side opposite to the direction of rotation; and where said interchangeable interface elements further have a bottom portion with a generally rounded surface arranged to cooperate with a generally rounded bottom portion of said interchangeable interface element mounting cutouts, a heel portion facing the direction of rotation and shaped to cooperate with a recess portion of said interchangeable interface element mounting cutouts so that during insertion of an individual interchangeable interface element in one said interchangeable interface element mounting cut-outs, by inserting said bottom portion first, the generally rounded surface is slidable past a protruding portion and into a relief recess portion of said interchangeable interface element mounting cut-outs, permitting said heel portion to clear said protruding portion and the interchangeable interface element to be seated with said bottom portion in said generally rounded bottom portion of said interchangeable interface element mounting cut-outs locking said individual interchangeable interface element from movement in a radial direction in said at least two rotor bodies, said plurality of interchangeable interface elements further having a first force absorbing surface, arranged on said trailing edge, and a second force absorbing surface, arranged on said leading edge, and interchangeable interface element securing fasteners, arranged to receive said rotor bundling means for securing said plurality of interchangeable interface elements to said at least two rotor bodies.

2. An interlocking interchangeable interface element and rotor assembly according to claim 1, wherein each of said plurality of interchangeable interface elements further has interchangeable interface element tip mounting means, arranged in an upper mounting portion of each said plurality of interchangeable interface elements, for receiving interface element tips.

3. An interlocking interchangeable interface element and rotor assembly according to claim 1, wherein each of said plurality of interchangeable interface elements further has knife-shaped interface element tips.

4. An interlocking interchangeable interface element and rotor assembly according to claim 1, wherein said rotors have a substantially cylindrical outer edge.

5. An interlocking interchangeable interface element and rotor assembly according to claim 4, wherein said rotor bundling means comprise rotor bolts and rotor nuts.

6. An interlocking interchangeable interface element and rotor assembly according to claim 5, wherein said at least two rotor bodies are fixably arranged on a rotatable shaft running through central mounting holes in said at least two rotor bodies.

7. An interlocking interchangeable interface element and rotor assembly according to claim 6, wherein said at least two rotor bodies are attached to said rotatable shaft using a pair of conical bushings arranged to clamp said rotatable shaft to said at least two rotor bodies.

8. An interlocking interchangeable interface element and rotor assembly according to claim 6, wherein said plurality of interchangeable interface elements have replaceable interchangeable interface element tips arranged at an outer end of said plurality of interchangeable interface elements facing said leading edge.

9. An interlocking interchangeable interface element and rotor assembly according to claim 8, wherein said assembly comprises interchangeable interface elements arranged in straight rows.

10. An interlocking interchangeable interface element and rotor assembly according to claim 8, wherein said assembly comprises interchangeable interface elements arranged along helical curves.

11. An interlocking interchangeable interface element and rotor assembly according to claim 8, wherein said rotatable shaft is rotated by a hydraulic motor.

12. An interlocking interchangeable interface element and rotor assembly according to claim 8, wherein said rotatable shaft is rotated by an electric motor.

13. An interlocking interchangeable interface element and rotor assembly according to claim 8, wherein said rotatable shaft is rotated by an internal combustion engine.

* * * * *

UNITED STATES PATENT AND TRADEMARK OFFICE

CERTIFICATE OF CORRECTION

PATENT NO. : 6,364,227 B1
DATED : April 2, 2002
INVENTOR(S) : Dorscht

It is certified that error appears in the above-identified patent and that said Letters Patent is hereby corrected as shown below:

Title page,
Item [*] Notice, delete the phrase “by 0 days” and insert -- by 17 days --

Signed and Sealed this

Ninth Day of November, 2004

JON W. DUDAS
*Director of the United States Patent and Trademark Office*